United States Patent [19]

Moss et al.

[11] Patent Number: 4,473,918

[45] Date of Patent: Oct. 2, 1984

[54] PIVOT HANDLE FOR DUST MOPS AND THE LIKE

[75] Inventors: Theron C. Moss; Earl Boring, both of Cleveland, Tenn.; Erwin Tomm, Cleveland, Ohio; Jerry Hjellum, Cleveland, Tenn.

[73] Assignee: SECO Industries, Inc., Cleveland, Tenn.

[21] Appl. No.: 449,899

[22] Filed: Dec. 15, 1982

[51] Int. Cl.[3] ..... A47L 13/38

[52] U.S. Cl. ..... 15/144 R; 15/229 AC

[58] Field of Search ..... 15/144 B, 144 R, 229 A, 15/229 AC, 229 B, 229 BC

[56] References Cited

U.S. PATENT DOCUMENTS

| | | | |
|---|---|---|---|
| 452,375 | 5/1891 | Helmond | 15/144 R X |
| 2,446,401 | 8/1948 | Ziskind | 15/144 R X |
| 2,469,050 | 5/1949 | Mygas | 15/144 R |
| 2,555,226 | 5/1951 | Draughn | 15/144 R X |
| 3,273,192 | 9/1966 | Mazzella | 15/230.11 |
| 3,407,424 | 10/1968 | Lanzarone et al. | 15/229 A X |
| 4,364,144 | 12/1982 | Moss et al. | 15/229 AC |

*Primary Examiner*—Chris K. Moore

*Attorney, Agent, or Firm*—Maky, Renner, Otto & Boisselle

[57] ABSTRACT

Handle includes a main handle portion and an outer end portion pivotally connected thereto. Both the main handle portion and outer end portion have connecting members extending from the adjacent ends thereof, with offset flanges thereon in overlapping engagement with each other and connected together by a bolt and nut arrangement. The opposed faces of such offset flanges have radially extending teeth in mating engagement with each other positively to retain the outer end portion in any desired adjusted position from straight out in line with the main handle portion to approximately 90° in either direction or anywhere in between upon loosening and retightening the nut.

9 Claims, 6 Drawing Figures

Fig. 1
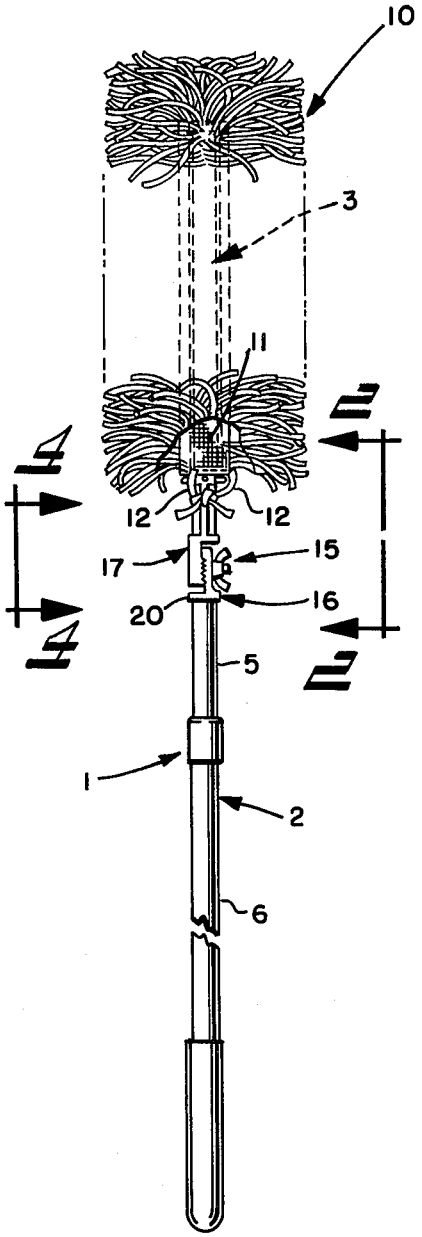
Fig. 3
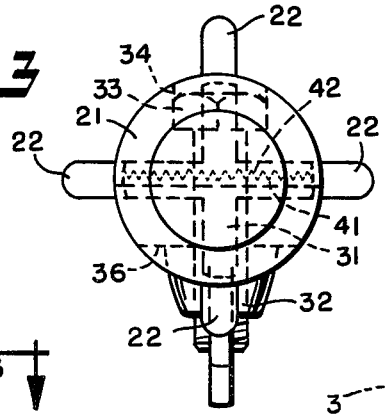
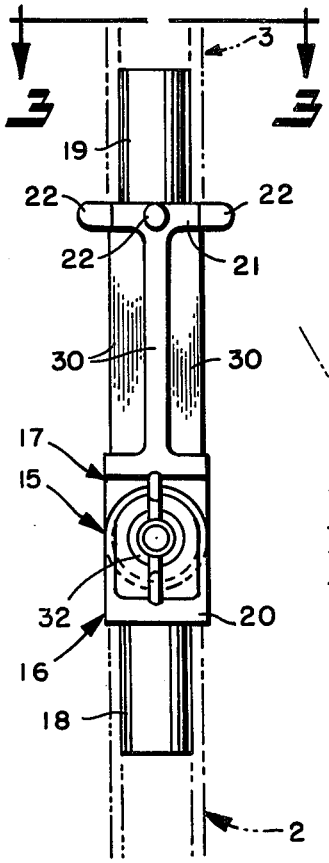
Fig. 2
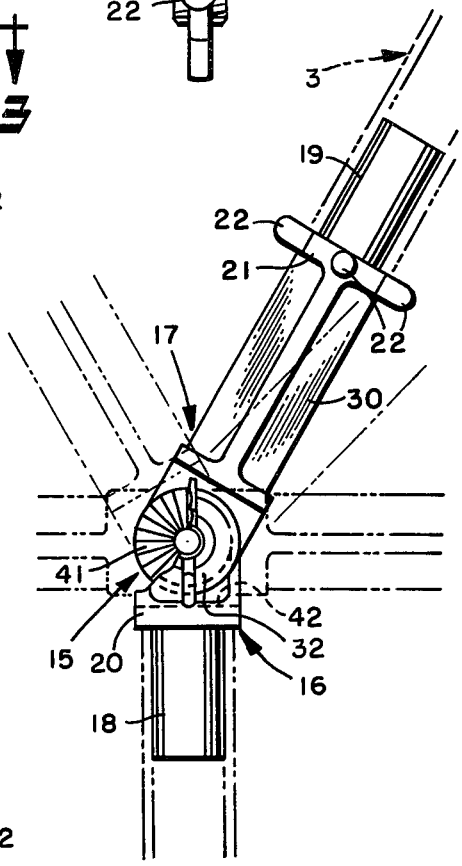
Fig. 6
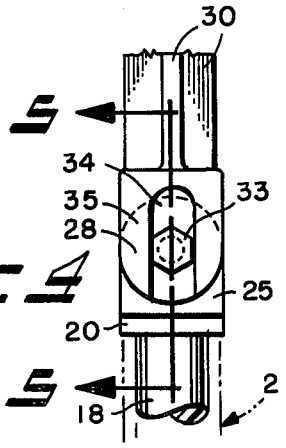
Fig. 4
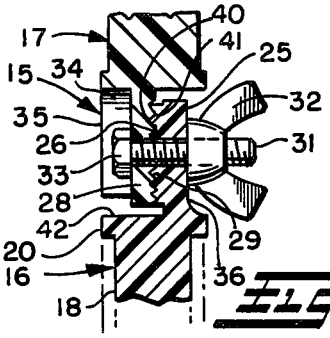
Fig. 5

PIVOT HANDLE FOR DUST MOPS AND THE LIKE

BACKGROUND OF THE INVENTION

This invention relates generally as indicated to a pivot handle for dust mops and the like.

There are many dusting applications where it would be particularly advantageous to be able to adjust the angle of the duster head relative to the main handle portion. Being able easily to adjust the duster head to a variety of dusting angles would greatly facilitate dusting of such normally difficult-to-dust surfaces as ledges and overhead shelves, the tops of doors, furnace ducts, pipes, and other such overhead surfaces.

SUMMARY OF THE INVENTION

With the foregoing in mind, it is a principal object of this invention to provide a handle having an angular adjustable outer end portion on which a dust mop or other device may be supported.

Another object is to provide such a handle for dust mops and the like which permits the duster head or other device supported thereby to be easily adjusted to a variety of dusting angles.

Still another object is to provide such a handle in which the outer end portion may be angularly adjusted anywhere from straight out from the main handle portion to substantially 90° in either direction or anywhere in between and positively locked in place in any one of such adjusted positions.

These and other objects of the present invention may be achieved by providing the handle with a main handle portion and an outer end portion pivotally connected thereto. The outer end portion has provision for attachment of a duster head or other such device thereto, and both the outer end portion and main handle portion have connecting members extending from the adjacent ends thereof, with offset flanges thereon in overlapping engagement with each other and connected together by a bolt and nut arrangement. The opposed faces of the offset flanges have teeth extending radially outwardly from their centers which are movable into overlapping engagement with each other to positively retain the outer end portion in any desired adjusted position from straight out from the main handle portion to approximately 90° in either direction or anywhere in between upon tightening the nut. When the nut is loosened, the tapered sides of the teeth permit the teeth to ride up over each other as the outer end portion is pivoted relative to the main handle portion. When the outer end portion is in the desired adjusted position, the nut is retightened, which urges the teeth into locking engagement with each other thus firmly and securely locking the outer end portion against further movement relative to the main handle portion.

To the accomplishment of the foregoing and related ends, the invention, then, comprises the features hereinafter fully described and particularly pointed out in the claims, the following description and the annexed drawings setting forth in detail a certain illustrative embodiment of the invention, this being indicative, however, of but one of the various ways in which the principles of the invention may be employed.

BRIEF DESCRIPTION OF THE DRAWINGS

In the annexed drawings

FIG. 1 is a side elevation view of a preferred form of pivot handle in accordance with this invention shown having a duster head attached thereto;

FIG. 2 is an enlarged side elevation view of the pivotal connection between the outer end portion and main handle portion of the pivot handle of FIG. 1 substantially as seen from the plane of the line 2—2 thereof;

FIG. 3 is a further enlarged end elevation view of the pivotal connection of FIG. 2 as seen from the plane of the line 3—3 thereof;

FIG. 4 is an enlarged fragmentary side elevation view of the pivotal connection as seen from the plane of the line 4—4 of FIG. 1 on the side opposite that shown in FIG. 2;

FIG. 5 is a fragmentary longitudinal section through the pivotal connection of FIG. 4 taken along the plane of the line 5—5 thereof; and FIG. 6 is an enlarged side elevation view of the pivotal connection similar to FIG. 2, but showing the pivotal connection in various different angular positions.

DESCRIPTION OF THE PREFERRED EMBODIMENT

Referring now in detail to the drawings, and initially to FIG. 1 thereof, there is shown a preferred form of pivot handle 1 in accordance with this invention which consists of a main handle portion 2 and an outer end portion 3 pivotally connected to the main handle portion as described hereafter.

The main handle portion may be of any desired length, and may be of a single piece construction if desired, but preferably consists of a pair of telescoping tubular handle parts 5, 6 which may readily be adjusted to different lengths for use in dusting light fixtures, overhead grill work and other hard-to-reach surfaces. Both such telescoping handle parts 5, 6 are preferably made from relatively thin-walled plastic extruded tubing, with the outer diameter of the inner tubular member 5 being slightly less than the inner diameter of the outer tubular member 6 to permit the tubular members to be telescopically received one within the other and axially displaced relative to each other. A suitable lock mechanism which may be of the type shown, for example, in U.S. Pat. No. 4,345,351, which is incorporated herein by reference, may also be provided for releasably locking the telescoping handle parts in any desired adjusted position.

The outer end portion 3 of the handle 1 is also desirably made of relatively thin-walled plastic extruded tubing, and is of sufficient length to provide adequate support and attachment of a duster head 10 or other such device thereto. The duster head shown in FIG. 1 includes a central sleeve portion 11 adapted to be slipped over the outer end portion 3 and secured thereto as by means of ties 12. Although such a pivot handle is particularly suited for use with duster heads of this general type, it will be appreciated that such handle may also be used in other applications as well.

Between the adjacent ends of the main handle portion 2 and outer end portion 3 is a pivotal connection 15 which permits the outer end portion and thus the duster head 10 supported thereby to be adjusted to a variety of angles to facilitate dusting of a variety of such normally difficult-to-dust surfaces as ledges and overhead shelves, the tops of doors, furnace ducts or pipes, wall-mounted television sets, and other such overhead surfaces. In the preferred form of the invention shown herein, such pivotal connection 15 is formed by the interconnection of a pair of substantially rigid connecting members 16, 17 attached to the adjacent ends of the main handle portion and outer end portion, respectively.

Such connecting members are preferably molded out of a suitable plastic material, and as best seen in FIGS. 2 and 6, have relatively short cylindrical end portions 18, 19 which are received in the adjacent tubular ends of the main handle portion 2 and outer end portion 3, respectively, and held in place as by a suitable adhesive. Also, both such connecting members desirably have stop shoulders 20, 21 adjacent such cylindrical end portions 18, 19 for limiting the extent to which such connecting members can be inserted into the respective tubular portions. Radial protrusions 22 may also be provided on the stop shoulder 21 for the connecting member 17 extending from the outer end portion 3 to facilitate tying of the duster head ties thereto if desired.

The connecting member 16 attached to the main handle portion 2 has an offset flange 25 extending longitudinally from one side of the stop shoulder 20 so that the inner face 26 thereof is generally in a plane substantially passing through the axial center of the main handle portion as shown in FIG. 5. Likewise, the connecting member 17 attached to the outer end portion 3 has an offset flange 28 extending longitudinally therefrom with its inner face 29 generally in a plane passing through the axial center of the outer end portion but on the opposite side of the connecting member 17. The flange 25 on the connecting member 17 is also desirably somewhat spaced from the stop shoulder 21 thereon as by providing a plurality of longitudinally extending ribs 30 therebetween which reduce the amount of plastic required while still obtaining the necessary strength and rigidity.

The inner faces 26, 29 of the offset flanges 25, 28 are overlapped and connected together as by a bolt 31 and nut 32 arrangement to permit the desired pivotal movement of the outer end portion 3 relative to the main handle portion 2. The bolt 31 extends through aligned openings in the two flanges 25, 28. Also, the head 33 of the bolt 31 is desirably recessed in a slot or groove 34 in the outer face 35 of one of the flanges 28. As best seen in FIG. 4, the groove 34 is of a width approximately equal to the distance between opposite sides of the bolt head 33 to prevent the bolt from turning during tightening and loosening of the nut.

The outer face 36 of the other flange 25 is preferably flat for flat engagement by the inner surface of the nut as further shown in FIG. 5. Also such nut is preferably in the form of a wing nut to facilitate tightening and loosening thereof by hand as required.

Moreover, the overlapping inner faces 26, 29 of the connecting member flanges 25, 28 desirably have a full complement of radial teeth 40, 41 extending radially outwardly from the respective bolt openings therein. As will be apparent, the outer end portion may be adjusted to any desired position from straight out from the main handle portion as shown in FIG. 1 up to approximately 90° in either direction or anywhere in between as shown in FIG. 6 upon loosening the wing nut. When the nut is loosened, the tapered sides of the teeth permit the teeth to ride up over each other as the outer end portion is pivoted relative to the main handle portion. Upon tightening the nut, the teeth are pressed into overlapping engagement with each other thus firmly and securely locking the outer end portion against further movement relative to the main handle portion. Adjustment of the outer end portion beyond 90° in either direction is not necessary, and is substantially precluded by engagement of the exterior surface of the connecting member flange 28 on the outer end portion 3 with the outer end face 42 of the stop shoulder 20 on the other connecting member 16 as schematically shown in FIG. 6.

Although the invention has been shown and described with respect to a certain preferred embodiment, it is obvious that equivalent alterations and modifications will occur to others skilled in the art upon the reading and understanding of the specification. The present invention includes all such equivalent alterations and modifications and is limited only by the scope of the claims.

The embodiments of the invention in which an exclusive property or privilege is claimed are defined as follows:

1. A pivot handle for dust mops and the like comprising a main handle portion and an outer end portion, said main handle portion and outer end portion having opposed ends connected together by connecting members extending therefrom, said connecting members having offset flanges in overlapping engagement with each other and pivotally connected together by a bolt and nut assembly, and radially extending teeth on the opposed inner faces of said flanges for positively retaining said outer end portion against pivotal movement upon tightening said nut and bolt assembly and permitting pivotal movement of said outer end portion relative to said main handle portion upon loosening said nut and bolt assembly, said main handle portion and outer end portion being made of tubing, and said connecting members having cylindrical end portions which extend into the respective adjacent tubular ends of said main handle portion and outer end portion, said connecting members having stop shoulders spaced from the outer ends of said cylindrical end portions which limit the extent to which said connecting members are inserted into the adjacent tubular ends of said main handle portion and outer end portion, respectively, said stop shoulder on said connecting member extending from said main handle portion being engageable by the connecting member extending from said outer end portion when said outer end portion has been pivoted beyond a certain point in either direction to preclude pivotal movement of said outer end portion substantially beyond 90° in either direction from a center position in substantial axial alignment with said main handle portion.

2. The pivot handle of claim 1 wherein said connecting members are molded out of plastic, and said stop shoulder on said connecting member extending from said outer end portion has plastic radial protrusions integrally molded thereon to facilitate tying of a dust mop and the like thereto.

3. The pivot handle of claim 2 wherein said flange on said connecting member extending from said outer end portion is longitudinally spaced from the associated stop shoulder by a plurality of longitudinally extending ribs therebetween which reduce the amount of plastic required while still obtaining the necessary strength and rigidity.

4. The pivot handle of claim 2 wherein said offset flanges extend longitudinally from opposite sides of the respective connecting members, and the opposed faces of said flanges are respectively generally in a plane substantially passing through the respective axial centers of said main handle portion and outer end portion, the outer face of one of said flanges having a slot therein, and said bolt having a bolt head which is received in said slot, said slot having a width approximately equal to the distance between opposite sides of said bolt head to prevent said bolt from turning during tightening and loosening of said nut.

5. The pivot handle of claim 4 wherein the outer face of the other of said flanges is substantially flat for flat engagement with the inner face of said nut, said nut being a wing nut to facilitate tightening and loosening by hand.

6. The pivot handle of claim 4 wherein said radial teeth extending substantially completely around the opposed inner faces of said flanges for positively retaining said outer end portion in any desired adjusted position upon tightening said bolt and nut assembly, said teeth having tapered sides which permit said teeth on the respective flanges to ride up over each other upon loosening said nut and bolt assembly for adjusting the angular position of said outer end portion relative to said main handle portion.

7. The pivot handle of claim 4 wherein said main handle portion comprises an outer tubular member and an inner tubular member telescopically received in said outer tubular member, said inner and outer tubular members being axially movable relative to each other to vary the length of said main handle portion.

8. A pivot handle for dust mops and the like comprising a main handle portion and an outer end portion, said main handle portion and outer end portion having opposed ends connected together by connecting members extending therefrom, said connecting members having offset flanges in overlapping engagement with each other and pivotally connected together by a bolt and nut assembly, and radially extending teeth on the opposed inner faces of said flanges for positively retaining said outer end portion against pivotal movement upon tightening said nut and bolt assembly and permitting pivotal movement of said outer end portion relative to said main handle portion upon loosening said nut and bolt assembly, said main handle portion and outer end portion being made of tubing, and said connecting members being molded out of plastic and having cylindrical end portions which extend into the respective adjacent tubular ends of said main handle portion and outer end portion, and stop shoulders spaced from the outer ends of said cylindrical end portions which limit the extent to which said connecting members are inserted into the adjacent tubular ends of said main handle portion and outer end portion, respectively, said stop shoulder on said connecting member extending from said outer end portion having plural radial protrusions integrally molded thereon to facilitate tying of a dust mop and the like thereto, and said flange on said connecting member extending from said outer end portion being spaced from the associated stop shoulder by a plurality of longitudinally extending ribs therebetween which reduce the amount of plastic required while still obtaining the necessary strength and rigidity.

9. The pivot handle of claim 8 wherein said offset flanges extend longitudinally from opposite sides of the respective connecting members, and the opposed faces of said flanges are respectively generally in a plane substantially passing through the respective axial centers of said main handle portion and outer end portion, the outer face of one of said flanges having a slot therein, and said bolt having a bolt head which is received in said slot, said slot having a width approximately equal to the distance between opposite sides of said bolt head to prevent said bolt head from turning during tightening and loosening of said nut, and the outer face of the other of said flanges being substantially flat for flat engagement by the inner face of said nut, said nut being a wing nut to facilitate tightening and loosening by hand.

* * * * *